US008696413B2

(12) United States Patent
King, Jr. et al.

(10) Patent No.: US 8,696,413 B2
(45) Date of Patent: Apr. 15, 2014

(54) CONTOURING SANDING DEVICE

(71) Applicants: John Wesley King, Jr., West Helena, AR (US); Shelley K. Haynes, West Helena, AR (US)

(72) Inventors: John Wesley King, Jr., West Helena, AR (US); Shelley K. Haynes, West Helena, AR (US)

(73) Assignee: ShelWes, LLC, Helena, AR (US)

( * ) Notice: Subject to any disclaimer, the term of this patent is extended or adjusted under 35 U.S.C. 154(b) by 0 days.

(21) Appl. No.: 13/969,397

(22) Filed: Aug. 16, 2013

(65) Prior Publication Data

US 2013/0331009 A1 Dec. 12, 2013

Related U.S. Application Data

(63) Continuation-in-part of application No. 13/135,879, filed on Sep. 16, 2011.

(51) Int. Cl.
*B24D 15/04* (2006.01)

(52) U.S. Cl.
USPC ..... 451/523; 451/344; 451/495; 451/524

(58) Field of Classification Search
USPC ..... 451/344, 490, 495, 514, 523, 524; 15/250.001, 250.43, 250.44, 250.451
See application file for complete search history.

(56) References Cited

U.S. PATENT DOCUMENTS

| | | | | | |
|---|---|---|---|---|---|
| 1,887,620 | A | * | 11/1932 | Bowlby | 451/356 |
| 2,634,446 | A | * | 4/1953 | Mackie et al. | 15/250.451 |
| 3,123,947 | A | * | 3/1964 | Rawley | 451/495 |
| 3,350,738 | A | * | 11/1967 | Anderson | 15/250.201 |
| 4,206,574 | A | * | 6/1980 | Dotsko | 451/495 |
| 4,567,621 | A | * | 2/1986 | Alley, Jr. | 15/250.41 |
| 4,766,636 | A | * | 8/1988 | Shinpo | 15/250.201 |
| 5,309,681 | A | | 5/1994 | Cheney | |
| 5,947,803 | A | * | 9/1999 | Gruner | 451/354 |
| 6,026,537 | A | * | 2/2000 | Hojnacki | 15/250.451 |
| 6,301,742 | B1 | * | 10/2001 | Kota | 15/250.46 |
| 6,494,770 | B1 | * | 12/2002 | Carlson | 451/344 |
| 7,131,902 | B2 | * | 11/2006 | Hope | 451/533 |
| 7,596,828 | B2 | * | 10/2009 | Evdokimo | 15/250.4 |
| 2010/0261414 | A1 | * | 10/2010 | Fronek | 451/28 |

* cited by examiner

*Primary Examiner* — Lee D. Wilson
*Assistant Examiner* — Tyrone V Hall, Jr
(74) *Attorney, Agent, or Firm* — Richard Blakely Glasgow

(57) ABSTRACT

A contouring sanding device includes a support plate, a sanding pad covered by an abrasive material (e.g. sand paper), and a pressure dispersal system allowing the sanding pad to automatically conform to the contours of the surface of the object being sanded. The sanding device also includes either a handle or a power tool attachment piece.

20 Claims, 6 Drawing Sheets

A.

B.

CONTOURING SANDING DEVICE

CROSS-REFERENCE TO RELATED APPLICATIONS

This application is a continuation-in-part of, and claims the benefit of, currently pending U.S. application Ser. No. 13/135,879, filed on Sep. 16, 2011, entitled "Contouring Sanding Pad," the disclosure of which is incorporated herein by reference.

STATEMENT REGARDING FEDERALLY SPONSORED RESEARCH OR DEVELOPMENT

Not applicable

BACKGROUND OF THE INVENTION

1. Field of the Invention

The present invention relates to a sanding device, and in particular, to a sanding device capable of automatically conforming to a contour of a surface of an object.

2. Brief Description of the Related Art

The sanding surface of the prior art sanding pads is substantially flat and rigid. Thus, they do not bend easily which makes sanding uneven surfaces difficult. These prior art sanding devices do not conform to changing surface areas. If there is a rounded or irregular area, the prior art sanding pads have the tendency to sand the high area too much and the low area too little. To combat this problem, some sanding devices are adjustable. However, these devices require manual adjustments which causes slow-down in the project.

It would therefore be desirable to develop a sanding device that automatically conforms to the contours of an object's surface. The sanding device of the present invention overcomes these drawbacks in the prior art by automatically conforming to the contours of an object's surface without manual adjustment, thereby allowing even sanding on uneven surfaces.

BRIEF SUMMARY OF THE INVENTION

The present invention is directed to a sanding device comprising: a support plate; a plurality of outer arms connected to said support plate, and a flexible sanding pad covered by an abrasive material, wherein said flexible sanding pad conforms to a contour of a surface of an object when pressure is exerted on said flexible sanding pad.

The present invention is also directed to a sanding device comprising: a sanding pad covered by an abrasive material; a handle or a power tool attachment piece joined to a support plate; a plurality of inner arms connected to the support plate and the sanding pad; and a plurality of outer arms connected to the plurality of inner arms, wherein the plurality of outer arms and the plurality of inner arms are operable to flex when pressure is exerted on the handle or power tool attachment piece thereby causing said sanding pad to conform to a contour of a surface of an object.

These and other features, objects and advantages of the present invention will become better understood from a consideration of the following detailed description of the preferred embodiments and appended claims in conjunction with the drawings as described following:

DETAILED DESCRIPTION OF THE INVENTION

Figure 1:
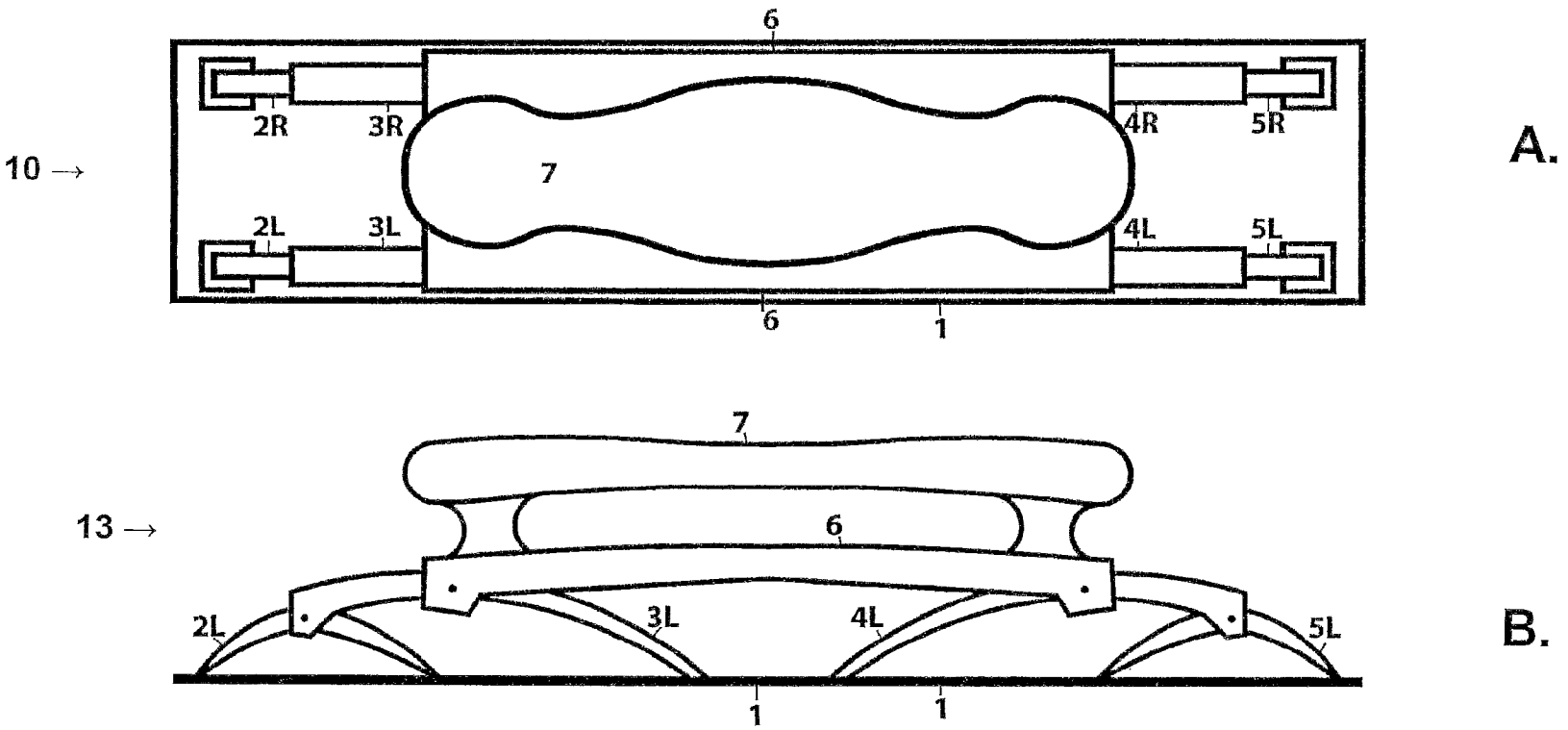
FIG. 1A is a top plan view of the first preferred embodiment of the sanding device of the present invention.
FIG. 1B is a side view of the first preferred embodiment of the sanding device of the present invention.

With reference to FIGS. 1A-6, the preferred embodiments of the present invention may be described. The sanding device 10 includes a support plate 6, a flexible sanding pad 1 covered by an abrasive material 9 (e.g. sand paper), and a pressure dispersal system 13 allowing the sanding pad to conform to the contours of the surface of the object 12 being sanded.

Figure 2:
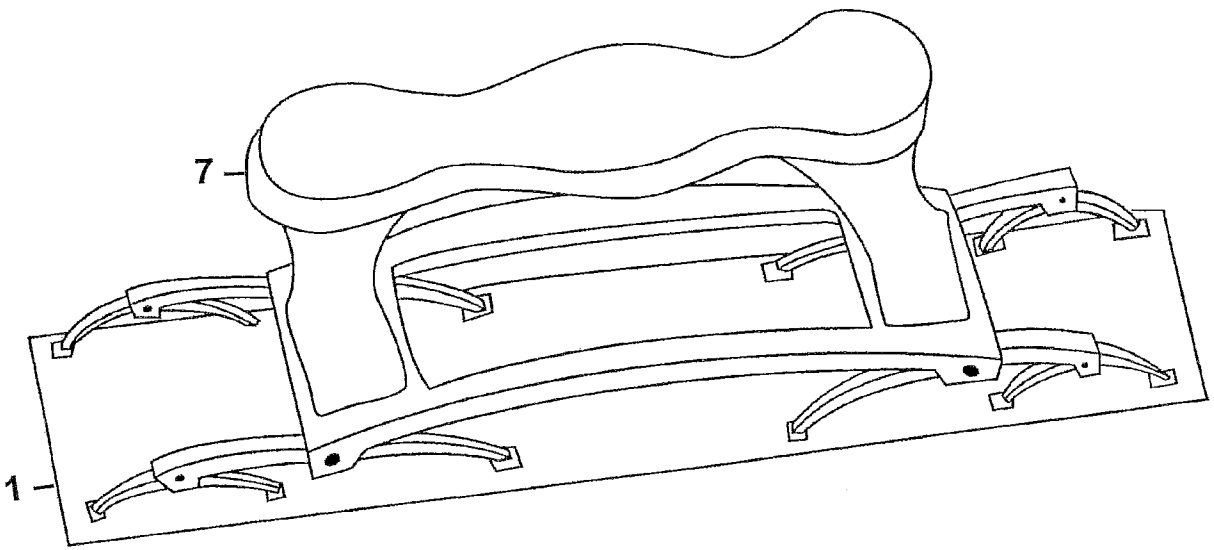
FIG. 2 is a perspective view of the first preferred embodiment of the sanding device of the present invention.
Figure 3:
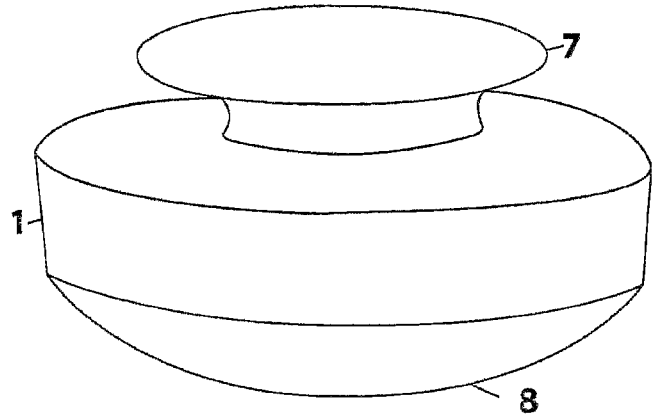
FIG. 3A is a perspective view of the second preferred embodiment of the sanding device of the present invention.
FIG. 3B is an exploded view of the second preferred embodiment of the sanding device of the present invention.
Figure 3:
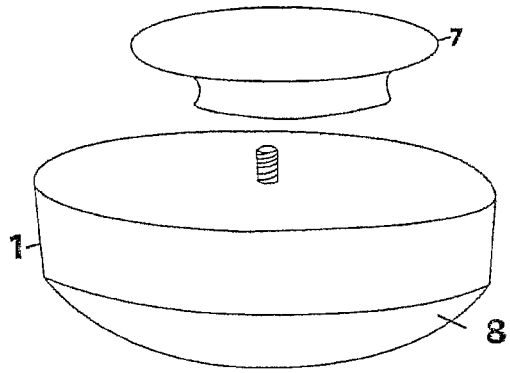

In the first preferred embodiment, as shown in FIGS. 1A-2, the sanding device 10 also includes a handle 7 for grasping and using the sanding device 10. In this embodiment, the pressure dispersal system 13 includes four outer arms 2R, 2L, 5R, 5L and four inner arms 3R, 3L, 4R, 4L. There are preferably two outer arms 2L, 2R and two inner arms 3L, 3R on one end of the sanding device 10, and two outer arms 5L, 5R and two inner arms 4L, 4R on the opposite end of the sanding device 10. The inner arms 3R, 3L, 4R, 4L are connected to the support plate 6. One end of each inner arm is connected to the sanding pad 1, while the other end of each inner arm is connected to an outer arm. Both ends of each outer arm 2R, 2L, 5R, 5L is connected to the sanding pad 1. As shown in FIG. 1A, there preferably is a space between the closest ends of the inner arms 3R, 3L, 4R, 4L. A liner (not shown) is preferably attached directly to the sanding pad 1 via an adhesive. The liner is preferably made of a rubber blend or similar material that would be well-known to those skilled in the art. The sandpaper or other abrasive material is then attached to the liner. The liner and sandpaper can be easily removed from the sanding pad 1 and replaced as needed.

When pressure is exerted on the handle 7 when the sanding device 10 is in use, the inner arms 3R, 3L, 4R, 4L and outer arms 2R, 2L, 5R, 5L flex towards to flexible sanding pad, thereby causing the sanding pad 1 to conform to the contours of the surface of the object being sanded (even uneven, rounded, or irregular surfaces). The sanding device 10 automatically conforms and continually self-adjusts to the shape of the surface as the surface is being sanded. The contouring sanding device 10 may be used on any surfaces, including but not limited to automobile surfaces, water craft surfaces, and airplane surfaces.

The sanding pad 1, support plate 6, inner arms 3R, 3L, 4R, 4L, and outer arms 2R, 2L, 5R, 5L are preferably made of aluminum or a similar material that would be well-known to those skilled in the art. The size of the sanding device 10 and its components may vary depending on the intended use of the device 10.

In the second preferred embodiment, as shown in FIGS. 3A-3B, the sanding device 10 also comprises a handle 7. To aid in sanding concave or convex surfaces, memory foam 8 may be joined to the sanding pad 1 and covered by the abrasive material 9. As shown in FIG. 3B, the handle may be removed and the sanding device attached to a power tool. The power tool is preferably air or electric powered and of a type that would be well-known to one skilled in the art.

In the third preferred embodiment, as shown in FIGS. 4A-6, the pressure dispersal system 13 preferably includes four outer arms 2R, 2L, 5R, 5L. There are preferably two outer arms 2L, 2R on one end of the sanding device 10, and two outer arms 5L, 5R on the opposite end of the sanding device 10. The outer arms 2R, 2L, 5R, 5L are connected to the support plate 6. The support plate 6 is preferably connected between outer arm 2R and outer arm 2L, and connected between outer arm 5R and outer arm 5L.

Figure 4A:
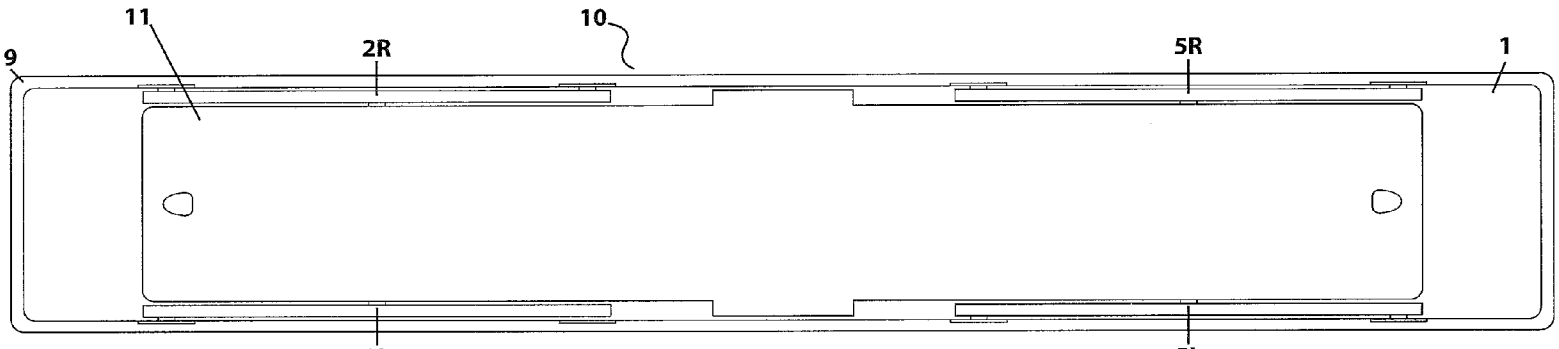
FIG. 4A is a top plan view of the third preferred embodiment of the sanding device of the present invention.
Figure 4B:
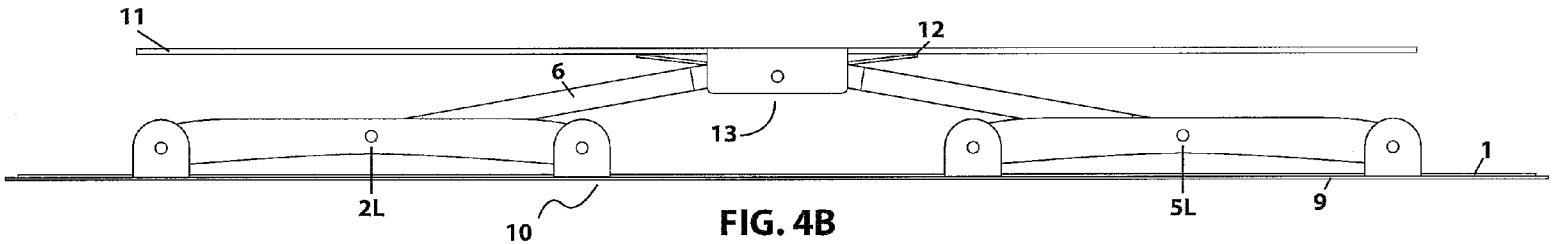
FIG. 4B is a front view of the third preferred embodiment of the sanding device of the present invention.
Figure 4C:
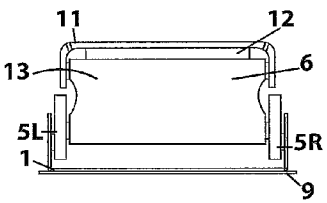
FIG. 4C is a side view of the third preferred embodiment of the sanding device of the present invention.
Figure 5:
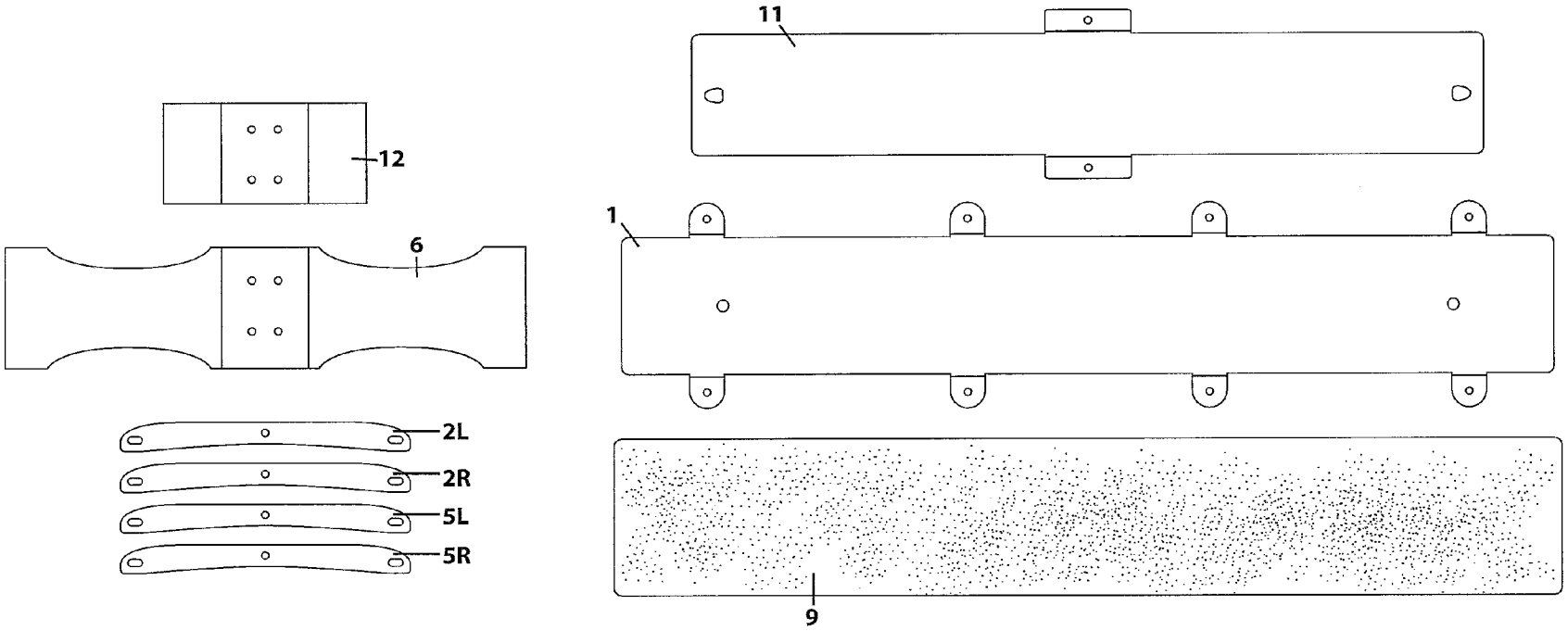
FIG. 5 is a top plan view of the individual components of the third preferred embodiment of the sanding device of the present invention.
Figure 6:
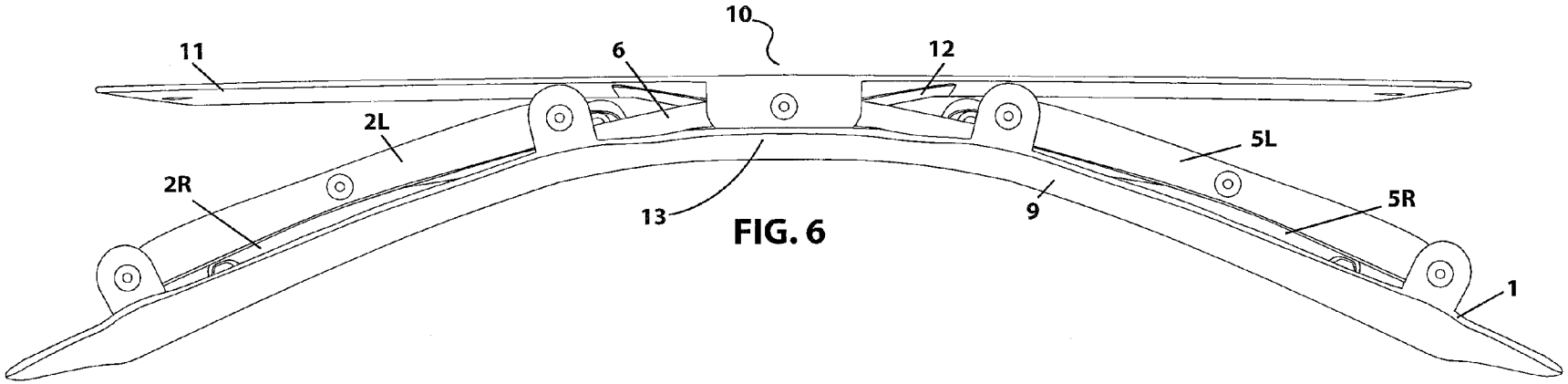
FIG. 6 is a perspective view of the third preferred embodiment of the sanding device of the present invention.

The sanding device of the third preferred embodiment may include either a handle 7 for manual sanding or a power tool attachment piece 11. In FIG. 4, a power tool attachment piece 11 is attached to the support plate 6. The attachment piece 11 is preferably rectangular shaped and has a flat top and bottom surfaces. Brackets are positioned on the sides of the attachment piece 11, which are attached to the sides of the support plate 6. A spring 12 is preferably attached to the support plate 6 between the support plate 6 and the attachment piece 11. The spring 12 is preferably made of steel or a similar material that would be well-known to those skilled in the art. The spring 12 functions to stabilize the connection between the support plate 6 and the handle 7 or attachment piece 11 and ensure that the pressure distribution is even throughout the sanding device 10. The spring 12 is a critical component to the functionality of the pressure dispersal system 13 because it provides flexibility to the sanding device 10 but also serves to limit the movement (e.g. flexing) of the two ends of the sanding pad 1 beyond a certain point, thereby preventing sanding errors on the surface being sanded. More particularly, when pressure is exerted on the attachment piece or on the handle 7, that pressure is in return applied evenly to the sanding pad 1 through the support plate 6 and the outer arms 2R, 2L, 5R, 5L. As a result, the flexible sanding pad 1 is pushed down until it contacts the surface of the object that it is resting on. In that regard, the flexible sanding pad 1 conforms to the contours of the surface of the object being sanded (even uneven, rounded, or irregular surfaces). FIG. 6 shows an example of a configuration of the sanding device 10 when sanding an object with a convex surface. Because the fixed outer arms of this embodiment do not extend through the middle portion of the sanding pad 1, the middle portion of the sanding pad 1 is capable of being either pushed towards the support plate 6 (convex surfaces) or away from the support plate 6 (concave surfaces). This feature allows even sanding of both convex and concave surfaces. The sanding device 10 has distinct advantages over the prior art sanders because it automatically conforms to the contours of the surface of the object being sanded without manual adjustments, thereby maximizing productivity in terms of quality and time efficiency. Use of the sanding device of the present invention also allows more precise sanding.

The present invention has been described with reference to certain preferred and alternative embodiments that are intended to be exemplary only and not limiting to the full scope of the present invention as set forth in the appended claims.

We claim:

1. A sanding device comprising:

(a) a sanding pad covered by an abrasive material;

(b) a support plate;

(c) a plurality of inner arms connected to said support plate and said sanding pad;

(d) a plurality of outer arms connected to said plurality of inner arms, wherein said plurality of outer arms and said plurality of inner arms are operable to flex when pressure is exerted on said support plate thereby causing said sanding pad to conform to a contour of a surface of an object.

2. The sanding device of claim 1, further comprising a handle connected to said support plate.

3. The sanding device of claim 1, further comprising an attachment piece, wherein said attachment piece is connectable to a power tool.

4. The sanding device of claim 1, wherein said plurality of outer arms have first ends and second ends, wherein said first ends and said second ends of said plurality of outer arms are connected to said sanding pad.

5. The sanding device of claim 4, wherein said plurality of inner arms are connected to said plurality of outer arms between said first ends and said second ends of said plurality of outer arms.

6. The sanding device of claim 1, wherein said plurality of inner arms have first ends and second ends, wherein said first ends of said plurality of inner arms are connected to said plurality of outer arms and said second ends of said plurality of inner arms are connected to said sanding pad.

7. The sanding device of claim 1, wherein said abrasive material is sandpaper.

8. The sanding device of claim 1, further comprising memory foam attached to said sanding pad.

9. The sanding device of claim 1, wherein said sanding device is connectable to a power tool.

10. The sanding device of claim 1, wherein said plurality of outer arms comprises four outer arms and said plurality of inner arms comprises four inner arms.

11. A sanding device comprising:

(a) a support plate;

(b) a plurality of outer arms connected to said support plate;

(c) a flexible sanding pad covered by an abrasive material, wherein said flexible sanding pad conforms to a contour of a surface of an object when pressure is exerted on said flexible sanding pad; and (d) a handle, wherein a spring is positioned between said handle and said support plate.

12. The sanding device of claim 11, wherein said plurality of outer arms have first ends and second ends, wherein said first ends and said second ends of said plurality of outer arms are connected to said sanding pad.

13. The sanding device of claim 11, wherein said abrasive material is sandpaper.

14. The sanding device of claim 11, further comprising memory foam attached to said sanding pad.

15. The sanding device of claim 11, wherein said plurality of outer arms comprises four outer arms.

16. A sanding device comprising:

(a) a support plate;

(b) a plurality of outer arms connected to said support plate;

(c) a flexible sanding pad covered by an abrasive material, wherein said flexible sanding pad conforms to a contour of a surface of an object when pressure is exerted on said flexible sanding pad; and (d) an attachment piece, wherein a spring is positioned between said attachment piece and said support plate.

17. The sanding device of claim 16, wherein said plurality of outer arms have first ends and second ends, wherein said first ends and said second ends of said plurality of outer arms are connected to said sanding pad.

18. The sanding device of claim 16, wherein said abrasive material is sandpaper.

19. The sanding device of claim 16, wherein said attachment piece is connectable to a power tool.

20. The sanding device of claim 16, wherein said plurality of outer arms comprises four outer arms.

* * * * *